US008512100B2

(12) United States Patent
Sakaguchi et al.

(10) Patent No.: US 8,512,100 B2
(45) Date of Patent: Aug. 20, 2013

(54) ABRASIVE TAPE, METHOD FOR PRODUCING ABRASIVE TAPE, AND VARNISHING PROCESS

(75) Inventors: Ryuji Sakaguchi, Chiba (JP); Kazuya Niwa, Ichihara (JP)

(73) Assignee: Showa Denko K.K., Tokyo (JP)

( * ) Notice: Subject to any disclaimer, the term of this patent is extended or adjusted under 35 U.S.C. 154(b) by 1023 days.

(21) Appl. No.: 12/488,223

(22) Filed: Jun. 19, 2009

(65) Prior Publication Data

US 2010/0003900 A1 Jan. 7, 2010

(30) Foreign Application Priority Data

Jul. 1, 2008 (JP) ..... P2008-172597

(51) Int. Cl.
*B24B 1/00* (2006.01)
*B24D 3/02* (2006.01)
*B24D 11/00* (2006.01)

(52) U.S. Cl.
USPC ..... 451/41; 51/295; 51/297; 51/298; 451/59; 451/63; 451/527; 451/533; 451/539

(58) Field of Classification Search
USPC ..... 451/41, 59, 63, 296, 295, 297, 298; 51/526, 527, 530, 533, 534, 539
See application file for complete search history.

(56) References Cited

U.S. PATENT DOCUMENTS

| | | | | |
|---|---|---|---|---|
| 5,633,068 | A * | 5/1997 | Ryoke et al. | 428/143 |
| 5,847,905 | A * | 12/1998 | Inaba et al. | 360/128 |
| 6,398,826 | B1 * | 6/2002 | Fujii et al. | 51/295 |
| 6,458,432 | B1 * | 10/2002 | Noguchi et al. | 427/549 |

FOREIGN PATENT DOCUMENTS

| | | | |
|---|---|---|---|
| JP | 3-237619 | A | 10/1991 |
| JP | 09-054943 | A | 2/1997 |
| JP | 11-277339 | A | 10/1999 |
| JP | 2001-079774 | A | 3/2001 |
| JP | 2004-511356 | A | 4/2004 |
| WO | 02/32626 | A1 | 4/2002 |

OTHER PUBLICATIONS

Notice of Reasons for Rejection for corresponding Japanese Application 2008-172597 mailing date: Oct. 23, 2012.

* cited by examiner

*Primary Examiner* — Timothy V Eley
(74) *Attorney, Agent, or Firm* — Sughrue Mion, PLLC

(57) ABSTRACT

There are provided an abrasive tape capable of suppressing contamination of a magnetic disk due to shattered abrasive particles and smoothing the surface of the magnetic disk; a method for producing an abrasive tape; and a varnishing process. An abrasive tape 1 produced according to the method for producing an abrasive tape of the invention is used in a process for varnishing a magnetic disk and produced according to a process for preparing a slurry by kneading and dispersing abrasive particles 5 and a binding agent 6; a process for forming a coating film by applying the slurry on a support 2; a process for forming an abrasive particle layer 3 by hardening the coating film; and a process for forming a coating layer 4 on the surface of the abrasive particle layer 3.

6 Claims, 5 Drawing Sheets

ABRASIVE TAPE, METHOD FOR PRODUCING ABRASIVE TAPE, AND VARNISHING PROCESS

BACKGROUND OF THE INVENTION

1. Field of the Invention

The present invention relates to an abrasive tape used for abrading and polishing the surface of a magnetic disk used, for example, in a hard disk device, a method for producing an abrasive tape, and a method for varnishing.

Priority is claimed on Japanese Patent Application No. 2008-172597 filed on Jul. 1, 2008 and the contents of which are hereby incorporated into this application.

2. Description of the Related Art

The recording density of magnetic disks used in hard disk devices is getting higher and the heads which float and travel on the magnetic recording surface are floating lower. In order to cope with these trends, it is required that the surface of a magnetic disk has a high flatness. Therefore, a process for producing a magnetic disk includes forming a magnetic layer or a protective layer on a non-magnetic substrate and after that, performing a varnishing process in which the surface of the layer is abraded using an abrasive tape to remove projections formed on or attached to the surface of the layer.

Such a varnishing process is carried out, for example, using an abrasive tape on which alumina abrasive grains is applied and includes abrading the surface of a medium by pressing the surface of a medium with the abrasive tape using a rubber contact roll. When such process is carried out, abnormal projections and the like on the surface of the medium are removed. Therefore, it is possible to allow a magnetic head to float quite low in a hard disk device and the like in which a magnetic disk is used (for example, refer to JP-A-11-277339).

As an abrasive tape (varnish tape) used in a varnishing process, a tape made of a polyester base film on which an abrasive layer is formed is generally used. When the abrasive layer comes into contact with the surface of a magnetic layer side of a magnetic disk and slides thereon, tiny dust particles adhering to the surface of the magnetic disk are removed and also abnormal projections and the like existing on the surface thereof are abraded and removed, thereby smoothing the surface. As an abrasive, a chromium oxide, α-alumina, a silicon carbide, a non-magnetic iron oxide, diamond, γ-alumina, α,γ-alumina, molten alumina, corundum, man-made diamond, and the like having an average particle size of around 0.05 μm to 50 μm are used (for example, refer to JP-A-9-054943).

Specifically, this kind of process for varnishing a magnetic disk using an abrasive tape is carried out by pressing the abrasive grain surface of the abrasive tape on the surface of a magnetic layer side of a magnetic disk while the magnetic disk is spinning. As a result, projections on the surface of the magnetic disk are removed and the surface thereof is smoothed. Herein, the abrasive tape is hung between a supply roll and a wind roll and travels therebetween, and is gradually supplied from the supply roll and wound on the wind roll. While the abrasive tape travels from the supply roll to the wind roll, the opposite surface (reverse surface) from the abrasive grain surface of the abrasive tape is pressed by a rubber backing roll, a felt, or the like to press the abrasive surface of the abrasive tape on the surface of the magnetic disk.

At present, the recording density of magnetic disks is getting higher and accordingly, it is necessary that the distance between the magnetic head and the magnetic disk becomes narrow. Therefore, contamination of the surface of the magnetic disk during the varnishing process is problematic.

According to our examinations, it has been found that alumina particles are included in materials contaminating the surface of the magnetic disk and that the alumina particles are abrasive particles detached from an abrasive tape during the varnishing process, shattered abrasive particles, or materials detached from the shattered particles. That is, it has been found that when projections on the surface of a magnetic disk are abraded and removed by the varnishing process, abrasive particles adhered to an abrasive tape are detached therefrom, the surface of the abrasive particles is slightly shattered (cleaved), the detached particles and powders of the shattered abrasive particles are adhered to the surface of the magnetic disk, thereby contaminating the surface of the magnetic disk.

Particularly in recent years, particles obtained by precipitation (crystal growth particles) rather than by shattering have been largely used as abrasive particles used in an abrasive tape. This is to decrease variation of the particle size and the surface shape of the abrasive particles in order to prevent producing even a tiny scratch on the surface to be subjected to the varnishing process as processing accuracy required in the varnishing process becomes higher. However, since the surface of the precipitation particles is smooth and has an almost spherical shape as compared to that of the shattered particles, it is difficult to stably hold the particles on the abrasive tape support. For this reason, it is considered that abrasive particles readily detach from an abrasive tape when the surface of a magnetic disk is subjected to a varnishing process.

In consideration of the above-mentioned problems, an advantage of some aspects of the present invention is to provide an abrasive tape capable of suppressing contamination of a magnetic disk by shattered abrasive particles and smoothing the surface of the magnetic disk; a method for producing an abrasive tape; and a varnishing process.

The present inventors have performed keen examination to solve the above-mentioned problems and as a result, they have found that when the surface of an abrasive particle layer of an abrasive tape used in a process for varnishing a magnetic disk is covered with a solid resin layer (coating layer) having the thickness in the range of 0.5 μm to 10 μm and the surface of the resin layer is covered with a liquid lubricant layer, it is possible to suppress the shattering of abrasive particles in the abrasive particle layer and the detachment of such shattered particles, and to decrease the contamination of the surface of the magnetic disk due to the abrasive tape, thereby completing the invention.

SUMMARY OF THE INVENTION

According to a first aspect of the invention, there is provided an abrasive tape used in a process for varnishing a magnetic disk, which includes a support; an abrasive particle layer which is disposed on the support and contains abrasive particles; and a coating layer which covers the surface of the abrasive particle layer, in which the coating layer is a solid layer of which the main component is a resin and has a thickness in the range of 0.5 μm to 10 μm.

According to a second aspect of the invention, as for the abrasive tape according to the first aspect of the invention, the resin which constitutes the solid layer is any one of a polyester resin, a polyurethane resin, and an epoxy resin.

According to a third aspect of the invention, as for the abrasive tape according to the first aspect of the invention, a liquid lubricant layer which contains a compound having a perfluoropolyether structure is formed on the solid layer.

According to a fourth aspect of the invention, there is provided a method for producing an abrasive tape used in a process for varnishing a magnetic disk, which includes a process for preparing a slurry by kneading and dispersing abrasive particles and a binding agent; a process for forming a coating film by applying the slurry on a support; a process for forming an abrasive particle layer by hardening the coating film; and a process for forming a coating layer on the surface of the abrasive particle layer.

According to a fifth aspect of the invention, as for the production method according to the fourth aspect of the invention, the coating layer is a solid layer of which the main component is a resin.

According to a sixth aspect of the invention, the production method according to the fourth aspect of the invention includes a process for providing a liquid lubricant layer on the surface of the coating layer after finishing a process for forming the coating layer.

According to a seventh aspect of the invention, as for the production method according to the fourth aspect of the invention, the coating layer has the thickness in the range of 0.5 μm to 10 μm.

According to an eighth aspect of the invention, as for the production method according to the fourth aspect of the invention, the coating layer contains at least any one of a polyester resin, a polyurethane resin, and an epoxy resin.

According to a ninth aspect of the invention, as for the production method according to the fourth aspect of the invention, the liquid lubricant layer contains a compound having a perfluoropolyether structure.

According to a tenth aspect of the invention, there is provided a process for varnishing a magnetic disk, which includes pressing and sliding the abrasive grain surface of an abrasive tape on the surface of a spinning magnetic disk to abrade the surface of the magnetic disk, in which the abrasive tape according to any one of the first aspect of the invention to the third aspect of the invention is used as the abrasive tape.

When the abrasive tape according to the invention is used to carry out a process for varnishing a magnetic disk, it is possible to suppress the shattering of abrasive particles in the abrasive particle layer and the detachment of shattered particles by the solid resin layer, to suppress contamination of the surface of the magnetic disk due to the shattered abrasive particles, and to smooth the surface of the magnetic disk.

In addition, when the method for producing an abrasive tape according the invention is employed, it is possible to easily and reliably produce the abrasive tape having the above-mentioned excellent characteristics.

Moreover, when the varnishing process according to the invention is employed, it is possible to suppress the shattering of abrasive particles in the abrasive particle layer and the detachment of shattered particles by the solid resin layer, to suppress contamination of the surface of the magnetic disk due to the shattered abrasive particles, and to smooth the surface of the magnetic disk.

DETAILED DESCRIPTION OF THE INVENTION

An abrasive tape, a method for producing an abrasive tape, and a varnishing process according to some aspects of the invention will be described below.

Abrasive Tape

First, an embodiment of an abrasive tape according to the invention will be described.

Figure 1:
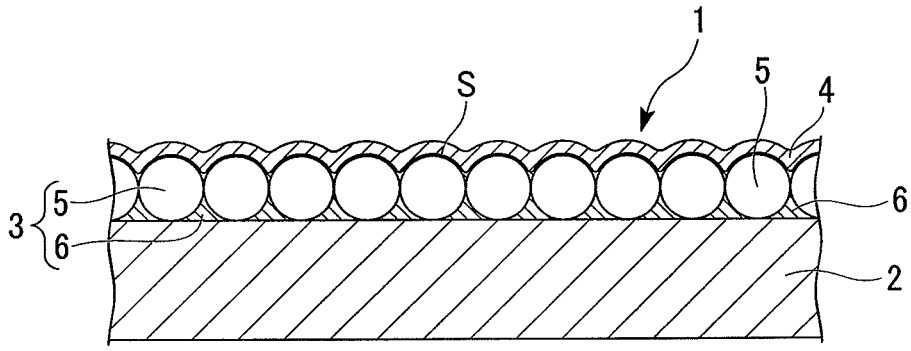
FIG. 1 is a longitudinal sectional view illustrating an example of an abrasive tape according to the invention.

FIG. 1 is a longitudinal sectional view illustrating an embodiment of an abrasive tape according to the invention.

When an abrasive surface S (surface of a coating layer) of an abrasive tape 1 according to the invention slides on the surface of a magnetic disk 10, abnormal projections existing on the surface of the magnetic disk 10 are abraded and removed, thereby smoothing the surface thereof.

The abrasive tape 1 includes a support 2, an abrasive particle layer 3 which is disposed on the support 2, and a coating layer 4 which covers the surface of the abrasive particle layer 3.

As the material constituting the support 2, although there is no specific limitation, various resins such as polyethylene terephthalate and the like are used.

The abrasive particle layer 3 contains abrasive particles 5 and a binding agent 6 and the shape of the abrasive particles 5 is reflected in the surface thereof so that the surface has irregularities.

As the abrasive particles 5, for example, particles made of a chromium oxide, α-alumina, a silicon carbide, a non-magnetic iron oxide, diamond, γ-alumina, α,γ-alumina, molten alumina, corundum, man-made diamond, and the like may be exemplified and these may be suitably used in combination with one, two or more kinds thereof.

The binding agent 6 functions to bind the abrasive particles 5 and the support 2, and bind the abrasive particles 5 with each other. As the binding agent, there is no specific limitation, and any of a thermosetting resin, a thermoplastic resin, a photosensitive resin, and the like may be used for example.

Examples of the thermosetting resin include a urea resin, a melamine resin, a phenol resin, an epoxy resin, an unsaturated polyester resin, an alkyd resin, a urethane resin, and the like.

Examples of the thermoplastic resin include an acrylonitrile butadiene styrene (ABS) resin, a butadiene styrene resin, a polybutadiene resin, an acrylic rubber type MBS resin, and the like.

Examples of the photosensitive resin include a methacryl resin, a phenol resin, a urea resin, a melamine resin, a polystyrene resin, a polyacetal resin, a polycarbonate resin, an epoxy resin, and the like.

These resins may be used alone or in a combination of two or more kinds thereof.

In the abrasive tape 1 according to the invention, the surface of the abrasive particle layer 3 is covered with the coating layer 4.

The coating layer 4 is a solid layer of which the main component is a resin and which has the thickness of 0.5 μm to 10 μm. In addition, the coating layer 4 is disposed along the surface of the abrasive particle layer 3 and, on the surface of the coating layer, irregularities which reflect the irregular shape of the surface of the abrasive particle layer 3 are formed. The abrasive tape 1 abrades and removes abnormal projections existing on the surface of the magnetic disk 10 by an abrasive operation using such irregularities. In the descriptions below, when a liquid lubricant layer described below is disposed on the surface of the coating layer 4 or the coated surface, the surface of the liquid lubricant layer may be referred to as the 'abrasive surface S'.

When the coating layer 4 is disposed on the surface of the abrasive particle layer 3, the abrasive particles 5 contained in the abrasive particle layer 3 are protected by the coating layer 4. Therefore, when a process for varnishing the magnetic disk 10 is carried out using the abrasive tape 1, it is possible to suppress the shattering of the abrasive particles 5 in the abrasive particle layer 3 and the detachment of the shattered particles, to suppress contamination of the magnetic disk 10 due to the shattered abrasive particles 5, and to smooth the surface of the magnetic disk 10.

As the resin which constitutes the coating layer 4, there is no specific limitation, but it is preferable that it contains at least any of a polyester resin, a polyurethane resin, and an epoxy resin. Since these resins easily become wet with the various abrasive particles 5 contained in the above-mentioned abrasive particle layer 3, when the abrasive particles 5 are shattered, it is possible to effectively maintain the shattered particles on the abrasive tape 1.

In regard to the thickness of the coating layer 4, it depends on the particle size of abrasive particles used in an abrasive tape. It is preferable that the thickness of the coating layer is in the range of 0.5 μm to 10 μm and more preferably 1 μm to 5 μm as compared to the abrasive particles having a thickness of 0.1 μm to 40 μm used in the process of varnishing a magnetic disk so that the thickness of the film could be 5 times to ¼ of the particle size of the abrasive particles in order to prevent the detachment or the shattering of the abrasive particles. In addition, when the particle size of the abrasive particles is fine, it is preferable to make the thickness of the coating layer thicker than the particle size of the abrasive particles, and when the particle size of the abrasive particles is coarse, it is preferable to make the thickness of the coating layer thinner than the particle size of the abrasive particles.

When the abrasive tape on which the coating layer 4 having the above-mentioned thickness is prepared is used for carrying out a process for varnishing the magnetic disk 10, it is possible to reliably prevent even tiny shattered particles, which are generated by shattering of the abrasive particles 5, from being scattered. As a result, it is possible to reliably prevent contaminating materials (shattered abrasive particles), which obstruct a magnetic head from floating and travelling on the surface of the magnetic disk 10, from being adhered to the surface of the magnetic disk 10.

When the thickness of the coating layer 4 is thinner than 0.5 μm, it is impossible to exhibit sufficient effect to prevent the shattering of the abrasive particles 5 and the detachment of the shattered particles. When the thickness of the coating layer 4 is thicker than 10 μm, it is possible to reliably prevent the shattering of the abrasive particles 5 and the detachment of the shattered particles. However, if the layer which contains a resin and the like covers the surface of the abrasive particles 5 too thickly, the result is that the abrasive tape does not perform its functions adequately.

In regard to the abrasive tape 1 according to the invention, it is preferable that the surface of the coating layer 4 is covered with a liquid lubricant layer. The liquid lubricant layer maintains the shattered particles produced by shattering the abrasive particles on the abrasive tape and in addition, makes it possible to stabilize the shearing force (dynamic friction coefficient) generated between the surface of the magnetic disk 10 and the surface of the abrasive tape 1 during the varnishing process, thereby suppressing the shattering of the abrasive particles 5.

As a liquid lubricant used in the liquid lubricant layer, although there is no specific limitation, it is preferable that the liquid lubricant contains a compound having a perfluoropolyether structure. When the surface of the coating layer 4 is covered with the liquid lubricant, the liquid lubricant may be transferred to the magnetic disk 10 by the varnishing process. However, since a compound having perfluoropolyether structure is generally used as the lubricant applied on the surface of the magnetic disk 10, it is advantageous because it is not problematic even if the liquid lubricant in the abrasive tape 1 is transferred to the magnetic disk 10.

Method for Producing Abrasive Tape

A method for producing the abrasive tape according to the invention will be described below.

The method for producing the abrasive tape according to the invention includes (1) a process for preparing a slurry by kneading and dispersing abrasive particles and a binding agent; (2) a process for forming a coating film by applying the slurry on a support; (3) a process for forming an abrasive particle layer by hardening the coating film; and (4) a process for forming a coating layer on the surface of the abrasive particle layer. Each process will be described below.

(1) Process for Preparing Slurry

At first, the slurry is prepared by kneading and dispersing abrasive particles 5 and a binding agent 6.

When the above-mentioned resins are used as the binding agent 6, the resins in their precursor state may be kneaded and dispersed with the abrasive particles. Herein, the resin precursor represents the material which undergoes a reaction during the various treatments carried out during the process for preparing the slurry, thereby becoming the desired resin and examples of the precursor include a monomer, an oligomer, and the like.

The slurry may contain a solvent. By using a solvent, it is possible to regulate the slurry to have a viscosity suitable for an application process described below.

There is no specific limitation on the solvent, and examples of the solvent include a ketone solvent, an ester solvent, an aromatic hydrocarbon solvent, an alcohol solvent, an ether solvent, and the like.

The amount of the abrasive particles 5 to be contained in the slurry is preferably 100 to 400 parts by mass and more preferably 200 to 400 parts by mass relative to the amount of the binding agent 6 or the precursor thereof. When the amount of the abrasive particles 5 to be contained in the slurry is greater than 400 parts by mass, the abrasive particles 5 readily detach from the obtained abrasive particle layer 3.

When the amount of the abrasive particles 5 to be contained in the slurry is smaller than 100 parts by mass, the abrasive particles 5 are immersed in the binding agent 6 so that the particle shape of the abrasive particles 5 does not easily make irregularities on the abrasive particle layer 3. As the kneading machine, any kneading machine which has been commonly used in a method for producing such type of abrasive tape may be used.

(2) Process for Forming Coating Film

After this, a coating film is formed by applying the slurry on a support 2.

As the method for applying the slurry, any method which has been commonly employed in a method for producing such type of abrasive tape may be employed. Examples of the method include a roll coating method, a coating method, and the like.

(3) Process for Hardening Coating Film

After this, an abrasive particle layer 3 is formed by hardening the coating film formed on the support 2.

As the method for hardening, any one of a heating treatment, ultraviolet light irradiation, and the like is suitably selected according to the kind of binding agent contained in the coating film.

According to the above processes, the abrasive particle layer 3 having irregularities which reflect the particle shape of the abrasive particles on the surface thereof is formed.

(4) Process for Forming Coating Layer

After this, a coating layer 4 is formed on the abrasive particle layer 3.

The coating layer 4 may be formed by applying a resin or the precursor thereof on the abrasive particle layer 3 and if necessary, performing a post treatment (hardening treatment) and the like.

The resin or the precursor thereof may be melted in a solvent to become a liquid resin material and the liquid resin material may be applied on the surface of the abrasive particle layer 3. In the above-mentioned manner, it is possible to regulate a resin coating material provided for application so that it has a suitable viscosity.

As the solvent, the same solvents as that in the above process (1) may be used.

As the method for application, the same methods as those in the above process (2) may be employed. As a result, it is possible to obtain the coating layer 4 having a surface shape which reflects the irregular shape of the surface of the abrasive particle layer 3.

(5) Process for Forming Liquid Lubricant Layer

After this, a liquid lubricant layer is formed on the coating layer 4.

The liquid lubricant layer may be formed by applying a lubricant solution, which is prepared by melting a liquid lubricant or a lubricant in a solvent, on the coating layer 4.

As the method for application, the same methods as those in the above process (2) may be employed.

This process is carried out according to need, and when the shattering of the abrasive particles 5 or the detachment of the shattered particles is sufficiently suppressed only by the coating layer 4, this process may be omitted. It is preferable that the thickness of the liquid lubricant layer is in the range of 0.0001 μm to 10 μm.

Figure 5:
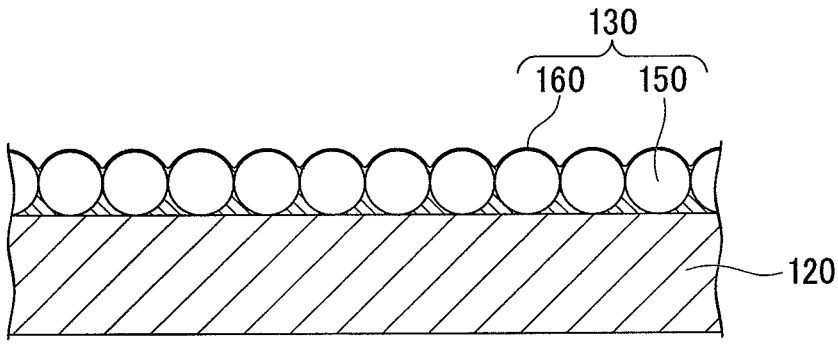
FIG. 5 is a longitudinal sectional view illustrating an example of an abrasive tape produced according to the known production method.

In the past, an abrasive tape is generally produced according to the processes (1) to (3) among the above-mentioned processes (1) to (4). Even in the known production methods, in order to knead abrasive particles with a binding agent in the process (1), the surfaces of the abrasive particles are covered with the binding agent. When this mixture is applied on a support and hardened, it is possible to obtain an abrasive particle layer 130 in which the surfaces of abrasive particles 150 are thinly covered with a binding agent 160 as shown in FIG. 5. The coating layer made of the binding agent 160 is very thin and according to the present inventors' analysis, the thickness of the coating film is thinner than 0.5 μm. As mentioned above, the thickness of the binding agent 160 which covers the upper surface of the abrasive particles 150 is thin because the binding agent 160 can cover the upper surface of the abrasive particles 150 right after applying the mixture but the binding agent 160 falls down to a support 120 by its own weight at the time of hardening. That is, in the eventually obtained abrasive tape, the binding agent 160 is unevenly distributed to near the surface of the support 120 so that the thickness of the film made of the binding agent 160 on the upper surfaces of the abrasive particles 150 becomes extremely thin.

Figure 6:
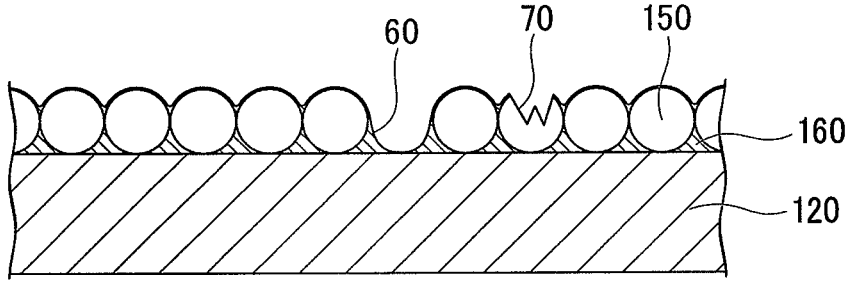
FIG. 6 is a cross-sectional view illustrating a state where abrasive particles are detached from the known abrasive tape or shattered.

In the case where the abrasive tape having such an abrasive particle layer 130 is used in a process for varnishing a magnetic disk, since the thickness of the binding agent 160 is thin, the abrasive particles 150 contained in the abrasive particle layer 130 readily detach therefrom or shatter, and the shattered particles readily detach from the abrasive tape, thereby contaminating the surface of the magnetic disk. For example, as shown in FIG. 6, the abrasive particles 150 contained in the abrasive tape may be detached therefrom to generate a particle detachment trace 60 or become shattered abrasive particles 70. The detached or shattered abrasive particles are detached from the abrasive tape, thereby contaminating the surface of the magnetic disk subjected to the varnishing process.

However, a production method according to the invention includes the process (4) for providing a solid coating layer 4 on the surface of the abrasive particle layer 3 produced according to the processes (1) to (3). According to an abrasive tape 1 produced in the above mentioned manner, the abrasive particles 5 contained in the abrasive particle layer 3 are protected by the coating layer 4. Therefore, when the magnetic disk 10 is subjected to the varnishing process using the abrasive tape 1, it is possible to reliably suppress the shattering of the abrasive particles 5 contained in the abrasive particle layer 3 and the detachment of the shattered particles, and suppress the contamination of the magnetic disk 10 by the particles shattered from the abrasive particles 5, thereby smoothing the surface of the magnetic disk 10.

Process for Varnishing

A varnishing process according to the invention will be described below.

Figure 2A:
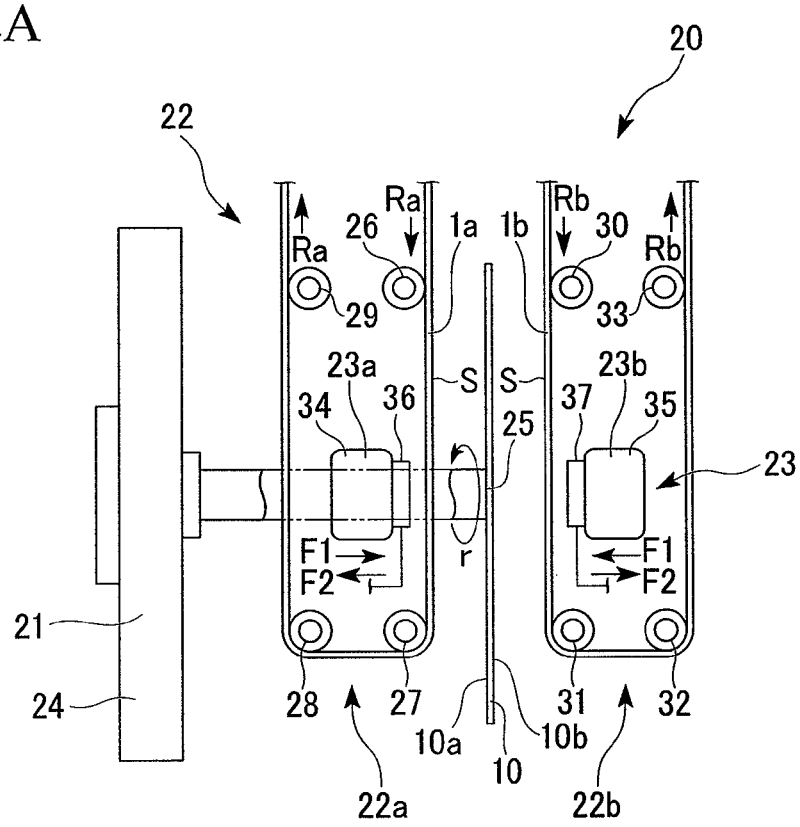
FIG. 2A is a view illustrating an example of a varnishing process device in which the abrasive tape shown in FIG. 1 is applied.
Figure 2B:
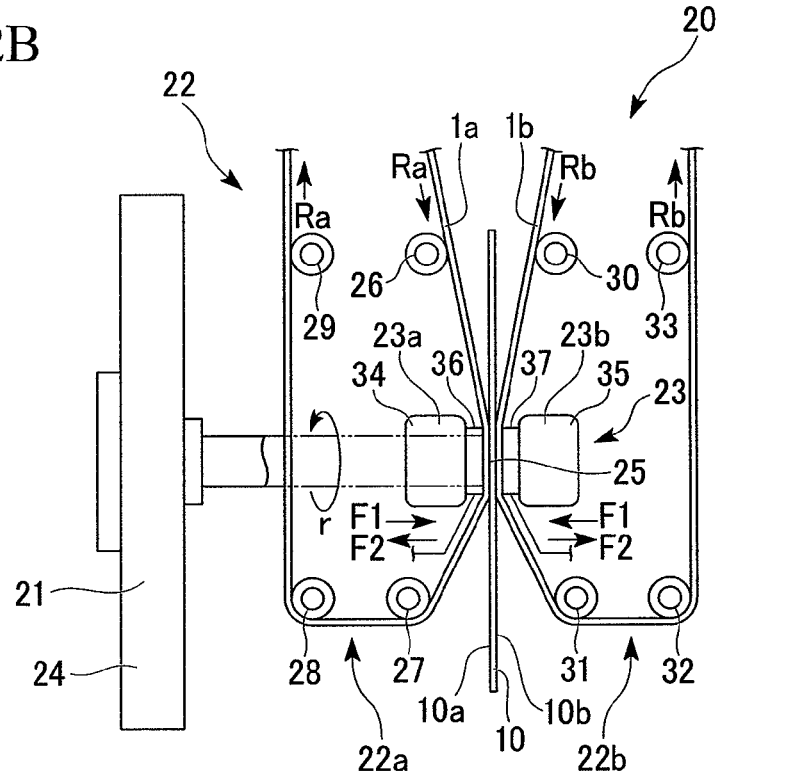
FIG. 2B is a view illustrating an example of a varnishing process device in which the abrasive tape shown in FIG. 1 is applied.
Figure 3:
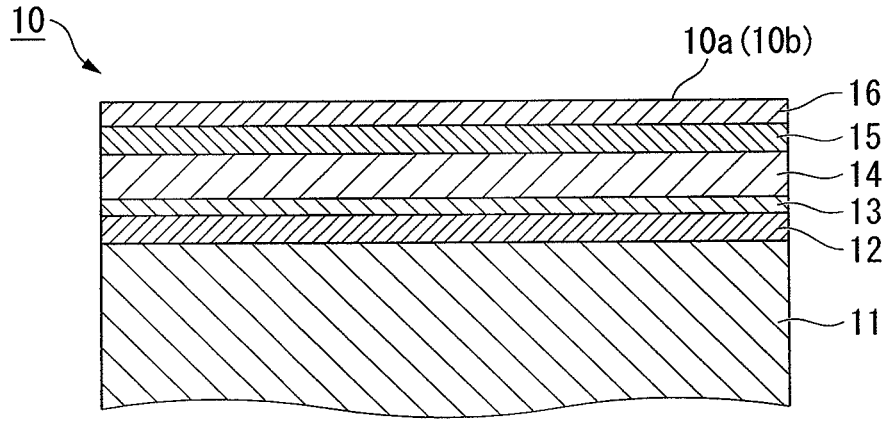
FIG. 3 is a longitudinal sectional view illustrating an example of a magnetic disk subjected to a process by the varnishing process device shown in FIGS. 2A and 2B.

FIGS. 2A and 2B are views illustrating an example of a varnishing process device which is used in a varnishing process according to the invention. FIG. 3 is a longitudinal sectional view illustrating an example of a magnetic disk subjected to a process according to a varnishing process according to the invention.

In accordance with the varnishing process according to the invention, when the abrasive surface S (surface of a coating layer (surface of a liquid lubricant layer when it is formed)) of the abrasive tape 1 presses and slides on the surface of a magnetic disk 10, abnormal projections existing on the surface of the magnetic disk 10 are abraded and removed.

At first, an example of the magnetic disk to which the varnishing process according to the invention is applied will be described with reference to FIG. 3.

The magnetic disk 10 shown in FIG. 3 is schematically configured in that an underlying layer 12, an intermediate layer 13, a magnetic layer 14, and a protective layer 15 are multilayered in order on both the main surfaces of a non-magnetic substrate 11 and a lubricant layer 16 is provided on the uppermost layer thereof.

As the material for the non-magnetic substrate 11, in general, a non-magnetic aluminum alloy material, a glass material, and the like used for the substrate of the magnetic disk 10 may be used without any limitations. Examples of the glass material include general soda glass, alumino-silicate type glass, noncrystalline glass, and the like. Examples of the aluminum alloy material include an Al—Mg alloy of which the main component is Al, and the like. In addition, as the material for the non-magnetic substrate 11, it is possible to use any materials as long as they are non-magnetic materials such as silicon, titanium, ceramics, various resin materials, and the like.

In addition, the non-magnetic substrate 11 may be configured with a base substance made of an aluminum material or a glass material and a film made of at least one kind selected from NiP, a NiP alloy, or another alloy, which is vapor-deposited on the surface of the base substance as a surface layer in accordance with a plating method, a sputtering method, and the like.

As the material for the underlying layer 12, a Cr alloy, which is made of at least one, two or more kinds selected from the group of Ti, Mo, Al, Ta, W, Ni, B, Si, Mn, and V, and Cr; or Cr may be used.

When the underlying layer 12 is configured so that the non-magnetic underlying layers are multilayered, at least one layer of the non-magnetic underlying layers may be the above-mentioned Cr alloy or Cr.

In addition, the non-magnetic underlying layer may be a NiAl alloy, a RuAl alloy, or a Cr alloy (alloy made of at least one or two or more kinds selected from the group of Ti, Mo, Al, Ta, W, Ni, B, Si, Mn, and V, and Cr).

In addition, when the non-magnetic underlying layer is configured to be multilayered, at least one layer of the non-magnetic underlying layers may be a NiAl alloy, a RuAl alloy, or the above-mentioned Cr alloy.

As the material for the intermediate layer 13, it is preferable to use a non-magnetic material, which is a Co alloy of which the main raw material is Co and which has a hcp structure, in order to promote epitaxial growth of the Co alloy. Examples of the Co alloy include a Co—Cr alloy, a Co—Cr—Ru alloy, a Co—Cr—Ta alloy, a Co—Cr—Zr alloy, and the like. It is preferable that the intermediate layer 13 contains any one kind selected from these Co alloys.

As the material for the magnetic layer 14, it is preferable to use a material which is a Co alloy of which the main raw material is Co and which has a hcp structure. Examples of the Co alloy include a Co—Cr—Ta alloy, a Co—Cr—Pt alloy, a Co—Cr—Pt—Ta alloy, a Co—Cr—Pt—B alloy, a Co—Cr—Pt—B—Cu alloy, and the like. It is preferable that the magnetic layer 14 contains any one kind selected from these Co alloys.

In addition, in the magnetic disk according to this embodiment, the magnetic layer may be configured in that two of more kinds of the magnetic layer are multilayered.

As the protective layer 15, carbon-based materials such as CVD carbon produced in accordance with a plasma CVD method, amorphous carbon, hydrogen-containing carbon, nitrogen-containing carbon, fluorine-containing carbon, and the like; and ceramic-based materials such as silica, zirconia, and the like may be suitably selected for use. Among these, rigid and dense CVD carbon is suitable for use from the view points of durability, economic efficiency, and productivity. When the film thickness of the protective layer 15 is too thin, durability deteriorates and when the thickness is too thick, great loss occurs in the case of reproducing records. Therefore, it is preferable to set the thickness as 10 to 150 Å (1 to 15 nm) and more preferably 20 to 60 Å (2 to 6 nm).

As the material for the lubricant layer 16, which is the uppermost layer, it is preferable to use a polymer of polymerizable unsaturated group-containing perfluoropolyether compounds. Examples of the polymerizable unsaturated group-containing perfluoropolyether compounds include a compound in which an organic group containing a polymerizable unsaturated bond is bonded to at least one end of perfluoropolyether, which is the main chain, and the like.

The magnetic disk subjected to the varnishing process according to the invention may be either a longitudinal magnetic disk or a perpendicular magnetic disk.

An example of a varnishing process device used in the varnishing process according to the invention will be described below with reference to FIGS. 2A and 2B.

A vanishing process device 20 shown in FIGS. 2A and 2B includes a magnetic disk spinning driver 21, abrasive tapes 1*a* and 1*b*, an abrasive tape travelling system 22, and an abrasive tape pressing unit 23.

The magnetic disk spinning driver 21 includes a spindle 24 driven to spin by a spindle motor (not shown) and a magnetic disk holder 25 mounted at the center of the spindle 24. In the magnetic disk holder 25, the center of the magnetic disk 10 is mounted and the magnetic disk 10 is held. When the spindle 24 is driven to spin while the magnetic disk 10 is held in the magnetic disk holder 25, the magnetic disk 10 is operated to spin in accordance with the spinning direction and the spinning rate of the spindle 24.

The magnetic disk spinning driver 21 is configured to cause the magnetic disk 10 to spin so that the scanning direction of a band of the spinning magnetic disk 10 is set to be in a direction (direction of an arrow r in FIGS. 2A and 2B) opposite to the travelling direction of a first abrasive tape 1*a* (direction of an arrow Ra in FIGS. 2A and 2B) which travels between a first guide roll 26 and a second guide roll 27, which will be described below, and a travelling direction of a second abrasive tape 1*b* (direction of an arrow Rb in FIGS. 2A and 2B) which travels between a fifth guide roll 30 and a sixth guide roll 31.

The abrasive tapes 1*a* and 1*b* are produced in accordance with the above-mentioned method for producing the abrasive tape and have an elongated shape.

The varnishing process device 20 includes the first abrasive tape 1*a*, which travels so as the abrasive surface S thereof faces a main surface 10*a* of one side of the magnetic disk 10, and the second abrasive tape 1*b*, which travels so as the abrasive surface S thereof faces a main surface 10*b* of the other side of the magnetic disk 10.

The abrasive tape travelling system 22 includes a first abrasive tape travelling system 22*a* disposed at one side of the magnetic disk 10 and a second abrasive tape travelling system 22*b* disposed at the other side thereof. The first abrasive tape travelling system 22*a* includes a supply roll and a wind roll, (not shown), as well as a first guide roll 26 to a fourth guide roll 29 disposed on the lower side of the supply roll and the wind roll.

Each spinning axis of the first guide roll 26 to the fourth guide roll 29 is disposed so as to be substantially parallel to the main surface 10*a* of one side of the magnetic disk 10 and substantially parallel to each other. The first guide roll 26 and the second guide roll 27 are disposed by leaving substantially the same distance from the main surface 10*a* of one side of the magnetic disk 10 and the third guide roll 28 and the fourth guide roll 29 are disposed in a location further from the magnetic disk 10 than that of the first guide roll 26 and the second guide roll 27 by leaving substantially the same distance from the main surface 10*a* of one side of the magnetic disk 10.

In the first abrasive tape travelling system 22*a* configured as mentioned above, the first abrasive tape 1*a* having an elongated shape is gradually sent out from the supply roll. The first abrasive tape 1*a* sent out from the supply roll is guided to the first guide roll 26 to the fourth guide roll 29 and travels along a U-shaped travelling path, thereby being wound on the wind roll. Herein, the abrasive surface S of the first abrasive tape 1*a* faces the main surface 10*a* of one side of the magnetic disk 10 when the first abrasive tape travels between the first guide roll 26 and the second guide roll 27.

On the other hand, the second abrasive tape travelling system 22*b* includes a supply roll and a wind roll (not shown), as well as a fifth guide roll 30 to a eighth guide roll 33.

The fifth guide roll 30 to the eighth guide roll 33 are disposed so as to be symmetrical with the first guide roll 26 to the fourth guide roll 29 across the magnetic disk 10.

In the second abrasive tape travelling system 22*b* configured as mentioned above, the second abrasive tape 1*b* having an elongated shape is gradually sent out from the supply roll. The second abrasive tape 1*b* sent out from the supply roll is guided to the fifth guide roll 30 to the eighth guide roll 33 and travels along a U-shaped travelling path, thereby being wound on the wind roll. Herein, the abrasive surface S of the second abrasive tape 1*b* faces the main surface 10*b* of the other side of the magnetic disk 10 when the second abrasive tape travels between the fifth guide roll 30 and the sixth guide roll 31.

The abrasive tape pressing unit 23 includes a first abrasive tape pressing unit 23*a* which presses the first abrasive tape 1*a* travelling between the first guide roll 26 and the second guide roll 27 to be in contact with (against) the main surface 10*a* side of one side of the magnetic disk 10 and a second abrasive tape pressing unit 23*b* which presses the second abrasive tape 1*b* travelling between the fifth guide roll 30 and the sixth guide roll 31 to be in contact with (against) the main surface 10*b* side of the other side of the magnetic disk 10.

When the first abrasive tape 1*a* travelling between the first guide roll 26 and the second guide roll 27 is pressed against the main surface 10*a* of one side of the magnetic disk 10 by the first abrasive tape pressing unit 23*a* and when the second abrasive tape 1*b* travelling between the fifth guide roll 30 and the sixth guide roll 31 is pressed against the main surface 10*b* side of the other side of the magnetic disk 10 by the second abrasive tape pressing unit 23*b* while the magnetic disk 10 is driven to spin in the arrow r direction as shown in FIGS. 2A and 2B by the magnetic disk spinning driver 21, the main surface 10*a* of one side of the magnetic disk 10 and the main surface 10*b* of the other side thereof slide respectively on the abrasive surface S of the first abrasive tape 1*a* and the abrasive surface S of the second abrasive tape 1*b*. Accordingly, abnormal projections existing on both the main surfaces of the magnetic disk 10 are abraded and removed by an abrasive operation of each of the abrasive tapes 1*a* and 1*b*, thereby smoothing both the main surfaces. In the varnishing process device 20 according to this embodiment, the unused abrasive tapes 1*a* and 1*b* are gradually sent out from the supply roll and wound on the wind roll after the tapes are used for abrasive treatment. Therefore, unused abrasive tapes 1*a* and 1*b* are supplied at all times to each main surface of the magnetic disk 10. Accordingly, it is possible to effectively abrade each of the main surfaces 10*a* and 10*b* of the magnetic disk 10.

It is preferable that the first abrasive tape pressing unit 23*a* and the second abrasive tape pressing unit 23*b* in which the part in contact with the abrasive tapes 1*a* and 1*b* is constituted by a material having flexibility. Therefore, it is possible to press the abrasive surfaces S of the abrasive tapes 1*a* and 1*b* against the surface of the magnetic disk 10 so as to cling thereto, thereby effectively abrading the surface of the magnetic disk 10. Examples of the first abrasive tape pressing unit 23*a* and the second abrasive tape pressing unit 23*b* include a unit configured to have a pressing member such as a pad made of a resin, woven fabrics, or the like, a rubber roller, and the like, so as to make such a pressing member touch the reverse surfaces of the abrasive tapes and to press the abrasive tapes 1*a* and 1*b* on the magnetic disk 10 side; and the like.

In the varnishing process device 20 according to this embodiment, the first abrasive tape pressing unit 23*a* and the second abrasive tape pressing unit 23*b* respectively include metal blocks 34 and 35; pads 36 and 37 mounted on one side of the metal blocks 34 and 35; and driving units (not shown) which operate the metal blocks 34 and 35 to reciprocally move in a horizontal direction (direction perpendicular to each of the main surfaces of the magnetic disk, an arrow F1 direction and F2 direction in the drawing).

In the abrasive tape pressing units 23*a* and 23*b*, as shown in FIG. 2A, when the driving units operate the metal blocks 34 and 35 to move in an arrow F1 direction in the drawing while the pads 36 and 37 are in a separated state (standby state) from the abrasive tapes 1*a* and 1*b*, the pads 36 and 37 touch the reverse surfaces of the abrasive tapes 1*a* and 1*b* and further press the abrasive tapes 1*a* and 1*b* to the magnetic disk 10 side. As a result, as shown in FIG. 2B, the abrasive surfaces S of the abrasive tapes 1*a* and 1*b* come in contact with the main surfaces of the magnetic disk 10. In this state, when the driving units operate the metal blocks 34 and 35 to move in an arrow F2 direction in the drawing, the abrasive tapes 1*a* and 1*b* are separated from the magnetic disk 10 and, in addition, the pads 36 and 37 are separated from the abrasive tapes 1*a* and 1*b*, thereby returning to the standby state.

An operation of the varnishing process device 20 will be described below.

At first, the first abrasive tape 1*a* and the second abrasive tape 1*b* are hung respectively on the first abrasive tape travelling system 22*a* and the second abrasive tape travelling system 22*b*.

The magnetic disk 10 is mounted and held in the magnetic disk holder 25.

As shown in FIG. 2A, in the varnishing process device 20, at an early stage, the pads 36 and 37 of the first abrasive tape pressing unit 23*a* and the second abrasive tape pressing unit 23*b* are respectively in locations separated (standby state) from the abrasive tapes 1*a* and 1*b*.

After that, while the operation of each section is turned on, the magnetic disk spinning driver 21 drives the magnetic disk 10 to spin in an arrow r direction in the drawing. Each of the supply rolls gradually sends out the first abrasive tape 1*a* and the second abrasive tape 1*b* respectively. The sent out first abrasive tape 1*a* is guided to the first guide roll 26 to the fourth guide roll 29 and travels along a U-shaped travelling path, thereby being wound on the wind roll. The sent out second abrasive tape 1*b* is guided to the fifth guide roll 30 to the eighth guide roll 33 and travels along a U-shaped travelling path, thereby being wound on the wind roll.

At this time, the abrasive surface S of the first abrasive tape 1*a*, which travels between the first guide roll 26 and the second guide roll 27, faces the main surface 10*a* of one side of the magnetic disk 10 and the first abrasive tape travels in a direction opposite to the scanning direction of a band of the magnetic disk 10.

The abrasive surface S of the second abrasive tape 1*b*, which travels between the fifth guide roll 30 and the sixth guide roll 31, faces the main surface 10*b* of the other side of the magnetic disk 10 and the second abrasive tape travels in a direction opposite to the scanning direction of a band of the magnetic disk 10.

After that, the first abrasive tape pressing unit 23*a* presses the first abrasive tape 1*a* travelling between the first guide roll 26 and the second guide roll 27 to (against) the main surface 10*a* side of one side of the magnetic disk 10 to make the abrasive surface S of the abrasive tape 1*a* touch the magnetic disk. The second abrasive tape pressing unit 23*b* presses the second abrasive tape 1*b* travelling between the fifth guide roll 30 and the sixth guide roll 31 to (against) the main surface 10*b* side of the other side of the magnetic disk 10 to make the abrasive surface S of the abrasive tape 1*b* touch the magnetic disk.

When the abrasive surface S of the travelling first abrasive tape 1*a* is pressed against the main surface 10*a* of one side of the magnetic disk 10 and when the abrasive surface S of the travelling second abrasive tape 1*b* is pressed against the main surface 10*b* of the other side of the magnetic disk 10 while the magnetic disk 10 is driven to spin in the arrow r direction, the main surface 10*a* of one side of the magnetic disk 10 and the main surface 10*b* of the other side thereof slide respectively on the abrasive surface S of the first abrasive tape 1*a* and the abrasive surface S of the second abrasive tape 1*b*. Accordingly, projections existing on both the main surfaces of the magnetic disk 10 are abraded and removed by an abrasive operation of each of the abrasive tapes 1*a* and 1*b*, thereby smoothing both the main surfaces.

According to the invention, when the coating layer 4 having the structure mentioned above is provided on the abrasive tape 1, it is possible to suppress the shattering of the abrasive particles 5 contained in the abrasive particle layer 3 and the detachment of the shattered particles, and to decrease the contamination of the magnetic disk 10 due to the shattered particles, thereby smoothing the surface of the magnetic disk 10. As a result, even though the processed magnetic disk 10 is inserted into a magnetic record reproducing device (hard disk device) in which a magnetic head floats low, it is possible to prevent the collision of the magnetic head and the magnetic disk 10, thereby obtaining an excellent operational property.

Magnetic Record Reproducing Device

An example of a magnetic record reproducing device in which a magnetic disk processed in accordance with a varnishing process according to the invention is inserted will be described below.

Figure 4:
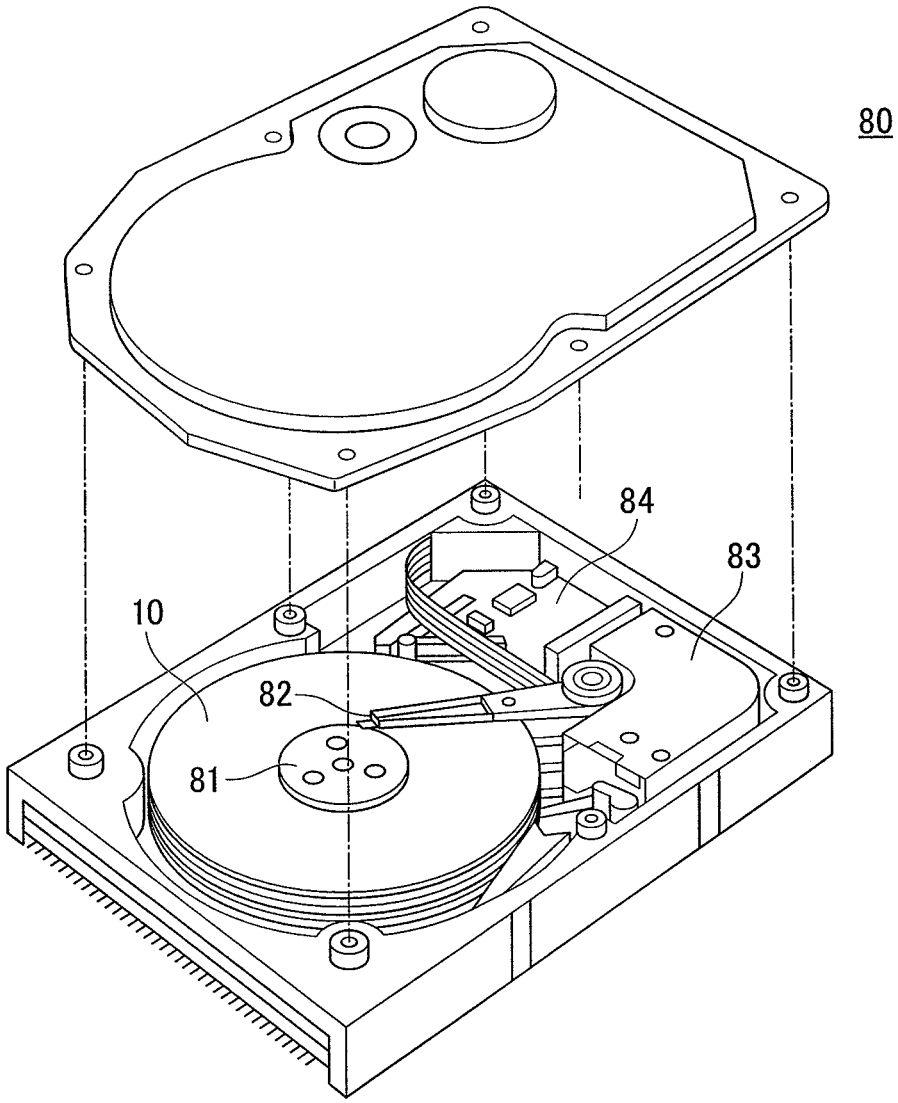
FIG. 4 is a schematic configuration view illustrating an example of a magnetic record reproducing device in which the magnetic disk shown in FIG. 3 is applied.

FIG. 4 is a schematic configuration view illustrating an example of the magnetic record reproducing device.

The magnetic record reproducing device 80 is equipped with a magnetic disk 10 processed in accordance with a varnishing process according to the invention, a medium drive section 81 which drives the magnetic disk 10 to spin, a magnetic head 82 which records information on the magnetic disk 10 and reproduces the recorded information, a head drive section 83 which makes the magnetic head 82 move in relation to a magnetic record medium 30, and a record reproducing signal processing system 84. The record reproducing signal processing system 84 is configured to deliver a record signal obtained by processing input data to the magnetic head 82 and output data obtained by processing a reproducing signal from the magnetic head 82.

In the magnetic record reproducing device 80, the surface of the magnetic disk 10 is smoothed in accordance with the varnishing process according to the invention, and has high smoothness and cleanness. Therefore, even if the magnetic head 82 floats low, it is possible to prevent collision of the magnetic head 82 and the magnetic disk 10, thereby obtaining excellent recording density and reliability.

EXAMPLES

Examples for substantiating the invention will be described below, but the invention is not limited thereto.

Production of Magnetic Disk

A washed glass substrate (manufactured by HOYA, outline 2.5 inches) was contained in a film-forming chamber of a DC magnetron sputtering device (manufactured by Anerba, trade name C-3010) and air in the film-forming chamber was evacuated until it reached to a degree of vacuum of $1\times10^{-5}$ Pa. A target of 89Co-4Zr-7Nb (Co content: 89 at %, Zr content: 4 at %, and Nb content: 7 at %) was used to form an underlying layer having a thickness of 100 nm on the glass substrate according to a sputtering process at a substrate temperature of 100° C. or lower.

After that, an intermediate layer having a thickness of 5 nm was formed on the underlying layer by heating the glass substrate at 200° C. and using a target 65Co-30Cr-5B. A magnetic layer 14 having a thickness of 25 nm was formed by using a target 61Co-20Cr-17Pt-2B. In the sputtering process, argon was used as a process gas for forming a film and pressure in the film-forming chamber was 0.5 Pa, thereby carrying out the film formation.

After that, according to a plasma CVD method, a protective layer having a thickness of 5 nm was formed on the magnetic layer.

According to a dipping method, a lubricant layer composed of perfluoropolyether was formed.

According to the above mentioned processes, a magnetic disk in which each layer is formed on a glass substrate was obtained.

Producing Abrasive Tape

Example 1

At first, a slurry containing crystal growth-type alumina particles having an average particle size of 0.5 μm and an epoxy resin was prepared.

The slurry was applied on a film made of polyethylene terephthalate and hardened so that a single particle layer composed of the alumina particles was adhered to the film, thereby forming an abrasive particle layer. The thickness of this abrasive particle layer from the film surface was around 0.3 μm and the thickness of the epoxy resin layer covering the upper surface of the alumina particles was around 0.2 μm.

After that, on the surface of the abrasive particle layer, a liquid resin material containing a polyurethane resin was applied and dried, thereby forming a coating layer. The thickness of the coating layer was around 1 μm.

In the above-mentioned manner, an abrasive tape was obtained.

Example 2

In the same manner as in Example 1, except that a liquid lubricant layer was formed on the surface of the coating layer by applying perfluoropolyether thereon to have a thickness of around 0.01 μm, an abrasive tape was obtained.

Comparative Example

In the same manner as in Example 1, except that the coating layer was formed on the surface of the abrasive particle layer, an abrasive tape was obtained Evaluation of Abrasive Tape Each abrasive tape produced in the above-mentioned manner was set in the varnishing process device shown in FIG. 2, and 1,000 magnetic disks produced as mentioned above were subjected to a varnishing process. Herein, the spinning rate of the magnetic disk was 300 rpm, the feeding rate of the abrasive tape was 10 mm/sec, the pressing force pressing the abrasive tape against the magnetic disk was 98 mN, and the processing time was 5 seconds.

The degree of contamination of each of the processed magnetic disks was evaluated by using a tester (surface testing device). The degree of contamination was evaluated such that the number of disks in which irregularities resulting from the shattered alumina particles (having a size of around 0.5 μm) had been found were measured. The results are shown in Table 1 below.

TABLE 1

| | Number of Disks in which Irregularities Resulting From Shattered Alumina Particles Were Found |
|---|---|
| Example 1 | 3 |
| Example 2 | 0 |
| Comparative Example | 5 |

As shown in Table 1, in the magnetic disk subjected to a varnishing process by the abrasive tapes produced in Examples 1 and 2, the contamination due to the shattered alumina particles was more suppressed as compared to the magnetic disk subjected to a varnishing process by the abrasive tape produced in the Comparative Example. Specifically, in the magnetic disk subjected to a varnishing process by the abrasive tape (Example 2) in which the liquid lubricant layer was formed, there were no irregularities due to the shattered alumina particles and the contamination was reliably suppressed.

When the abrasive tape according to the invention is used, it is possible to decrease the contamination of a magnetic disk due to shattered abrasive particles and smooth the surface of the magnetic disk. Therefore, the abrasive tape according to the invention is suitable for use as an abrasive tape used in a process for varnishing a magnetic disk specifically applied to a hard disk device in which the head floats low.

In accordance with a method for producing the abrasive tape according to the invention, it is possible to reliably produce such abrasive tape with simple processes. Therefore, it is possible to obtain an abrasive tape having an excellent abrasive property with satisfactory productivity.

While preferred embodiments of the invention have been described above, the present invention is not limited to these embodiments. Additions, omissions, substitutions, and other modifications can be made without departing from the purpose of the present invention. Accordingly, the invention is not to be considered as being limited by the foregoing description, and is only limited by the scope of the appended claims.

What is claimed is:

1. A process for varnishing a magnetic disk, comprising:

pressing and sliding an abrasive grain surface of an abrasive tape on the surface of a spinning magnetic disk to abrade the surface of the magnetic disk, wherein the abrasive tape comprises:

a support;

an abrasive particle layer which is disposed on the support and which contains abrasive particles and which has a surface with an irregular shape; and a coating layer which covers the surface of the abrasive particle layer, wherein the coating layer is a solid layer of which the main component is a resin and has a thickness in the range of 0.5 μm to 10 μm, having irregularities formed on the surface of the coating layer which reflect the irregular shape of the surface of the abrasive particle layer, and the abrasive tape comprises a liquid lubricant layer which contains a compound having a perfluoropolyether structure formed on the solid layer.

2. The process according to claim 1, wherein the resin which constitutes the solid layer of the abrasive tape is any one of a polyester resin, a polyurethane resin, and an epoxy resin.

3. The process according to claim 1, wherein the abrasive tape is produced by a process, comprising:

a process for preparing a slurry by kneading and dispersing abrasive particles and a binding agent;

a process for forming a coating film by applying the slurry on a support;

a process for forming an abrasive particle layer by hardening the coating film; and a process for forming a coating layer on the surface of the abrasive particle layer.

4. The process according to claim 3, wherein the process for producing the abrasive tape further comprises a process for providing a liquid lubricant layer on the surface of the coating layer after finishing the process for forming the coating layer.

5. The process according to claim 4, wherein the liquid lubricant layer contains a compound having a perfluoropolyether structure.

6. The process according to claim 3, wherein the coating layer in the process for forming a coating layer contains at least any one of a polyester resin, a polyurethane resin, and an epoxy resin.

* * * * *